US008877145B2

(12) United States Patent
Metz et al.

(10) Patent No.: US 8,877,145 B2
(45) Date of Patent: Nov. 4, 2014

(54) DEVICE AND METHOD FOR GENERATING A DROP OF A LIQUID

(75) Inventors: Tobias Metz, Buch am Erlbach (DE); Peter Koltay, Freiburg (DE)

(73) Assignee: Albert-Ludwigs-Universitaet Freiburg, Freiburg (DE)

( * ) Notice: Subject to any disclaimer, the term of this patent is extended or adjusted under 35 U.S.C. 154(b) by 764 days.

(21) Appl. No.: 13/106,206

(22) Filed: May 12, 2011

(65) Prior Publication Data

US 2011/0259924 A1 Oct. 27, 2011

Related U.S. Application Data

(63) Continuation of application No. PCT/EP2009/008097, filed on Nov. 13, 2009.

(30) Foreign Application Priority Data

Nov. 14, 2008 (DE) ..... 10 2008 057 291

(51) Int. Cl.
*B01L 3/02* (2006.01)
*B22D 41/005* (2006.01)
*B41J 2/21* (2006.01)

(52) U.S. Cl.
CPC ..... *B41J 2/211* (2013.01)
USPC ..... 422/515; 422/501; 422/504; 422/509; 422/518; 422/521; 73/863.32; 73/864; 73/864.01; 222/591

(58) Field of Classification Search
CPC ..... B01L 3/02; B01L 3/0203; B01L 3/021; B01L 3/022; B01L 3/0234; B01L 3/0241; G01N 35/10; G01N 35/1002; G01N 35/1009; G01N 35/1016
USPC ..... 422/501, 504–505, 507–509, 515, 518, 422/521; 73/863.32, 863.33, 864, 864.01, 73/864.02, 864.11, 864.12, 864.13, 73/864.15, 864.16, 864.21, 864.34; 436/180; 222/591
See application file for complete search history.

(56) References Cited

U.S. PATENT DOCUMENTS 5,777,636 A 7/1998 Naganuma et al.
5,958,122 A 9/1999 Fukuda et al.
(Continued)

FOREIGN PATENT DOCUMENTS

DE 102 19 141 A1 11/2002
DE 600 30 606 T2 9/2007
(Continued)

OTHER PUBLICATIONS

Koltay et al., "Highly Parallel and Accurate Nanoliter Dispenser for High-Throughput-Synthesis of Chemical Compounds", IMEMS Workshop 2001, Singapore, Jul. 4-6, 2001, 10 pages.
(Continued)

*Primary Examiner* — Brian R Gordon
(74) *Attorney, Agent, or Firm* — Keating & Bennett, LLP

(57) ABSTRACT

A device for generating a drop of a primary liquid is described, including: a reservoir fillable with the primary liquid, a pressure generation device for generating a hydraulic pressure on the primary liquid, at least one inlet channel for introducing a secondary fluid, and a channel having a flow cross-section transverse to a main flow direction, wherein the flow cross-section includes a main region and at least one sub-region extending from the main region, designed such that the primary liquid can be held in the main region by capillary forces, and the secondary fluid can be held in the sub-region by capillary forces, wherein the reservoir is fluidically connected to a first end of the channel via an output opening, and the at least one inlet channel is also fluidically connected to the channel, and wherein the pressure generation device is implemented to apply a hydraulic pressure to the primary liquid, whereby the same is moved along the channel and output at a second end of the channel as free-flying drop.

15 Claims, 12 Drawing Sheets

(56) References Cited

U.S. PATENT DOCUMENTS

| | | | | |
|---|---|---|---|---|
| 6,036,295 | A | 3/2000 | Ando et al. | |
| 6,251,488 | B1 | 6/2001 | Miller et al. | |
| 6,520,626 | B1 | 2/2003 | Murakami | |
| 7,955,864 | B2 * | 6/2011 | Cox et al. | 436/180 |
| 2002/0015069 | A1 | 2/2002 | Yamamoto et al. | |
| 2002/0163564 | A1 | 11/2002 | Leu et al. | |

FOREIGN PATENT DOCUMENTS

| | | | |
|---|---|---|---|
| EP | 0 655 337 | A2 | 5/1995 |
| EP | 0 739 742 | A2 | 10/1996 |
| EP | 0 739 956 | A2 | 10/1996 |

OTHER PUBLICATIONS

Koltay et al., "Massive Parallel Liquid Dispensing in the Nanoliter Range by Pneumatic Actuation", 8th International Conference on New Actuators, Jun. 10-12, 2002, Bremen, Germany, pp. 235-239.

Koltay et al., "Non-Contact Nanoliter & Picoliter Liquid Dispensing", The 14th International Conference on Solid-State Sensors, Actuators and Microsystems, Lyon, France, Jun. 10-14, 2007, pp. 165-170.

De Gennes et al., "Capillarity and Wetting Phenomena: Drops, Bubbles, Pearls, Waves", New York, Springer, 2003, 7 pages.

Rayleigh, "On the Instability of Jets", Proceedings of the London Mathematical Society 1878, Nov. 14, 1878, pp. 4-12.

Lindemann, "Droplet Generation—From the Nanoliter to the Femtoliter Range", PhD Dissertation, Institut für Mikrosystemtechnik (IMTEK) Lehrstuhl für Anwendungsentwicklung, Fakultät für Angewandte Wissenschaften Albert-Ludwigs-Universität Freiburg, 2006, 200 pages.

Steger et al., "The Dispensing Well Plate: A Novel Device for Nanoliter Liquid Handling in Ultra High-Throughput Screening", Journal of the Association for Laboratory Automation, vol. 9, No. 5, Oct. 2004, pp. 291-299.

Koltay et al., "The dispensing well plate: a novel nanodispenser for the multi-parallel delivery of liquids (DWP Part I)", Sensors and Actuators A—Physical, vol. 116, No. 3, Oct. 2004, pp. 483-491.

Koltay et al., "Theoretical evaluation of the dispensing well plate method (DWP Part II)", Sensors and Actuators A—Physical, vol. 116, No. 3, Oct. 2004, pp. 472-482.

Lemmermeyer, "Ein hochtemperaturbeständiger Einzeltropfenerzeuger für flüssige Metalle", Technische Universität München, Jan. 23, 2006, 141 pages.

Anna et al., "Formation of dispersions using 'flow focusing' in microchannels", Applied Physics Letters, vol. 82, No. 3, Jan. 20, 2003, pp. 364-366.

Okushima et al., "Controlled production of monodisperse double emulsions by two-step droplet breakup in microfluidic devices", Langmuir, vol. 20, No. 23, Nov. 2004, pp. 9905-9908.

Orme, "On the Genesis of Droplet Stream Microspeed Dispersions", Physics of Fluids A—Fluid Dynamics, vol. 3, No. 12, Dec. 1991, pp. 2936-2947.

Sugiura et al., "Prediction of droplet diameter for microchannel emulsification", Langmuir, vol. 18, No. 10, May 2002, pp. 3854-3859.

Metz et al., "STARTUBE: A Novel Tube Design for Bubble Tolerant Interconnection in Fluidic Systems", 2008, vol. 24, No. 17, pp. 9204-9206.

Official Communication issued in International Patent Application No. PCT/EP2009/008097, mailed on Apr. 8, 2010.

* cited by examiner

DEVICE AND METHOD FOR GENERATING A DROP OF A LIQUID

CROSS-REFERENCE TO RELATED APPLICATIONS

This application is a continuation of International Application No. PCT/EP2009/008097, filed Nov. 13, 2009, which is incorporated herein by reference in its entirety, and additionally claims priority from German Application No. DE 102008057291.8, filed Nov. 14, 2008, which is incorporated herein by reference in its entirety.

BACKGROUND OF THE INVENTION

The present invention relates to devices and methods for generating a drop of a liquid, e.g. for dosing systems for the dosage of small amounts of liquids.

The dosage of small amounts of liquids is widespread in many fields of application from inkjet printer to the production of microarrays, and different methods are used. Such methods are described, for example, in the following expert publications: P. Koltay, G. Birkle, R. Steger, H. Kuhn, M. Mayer, H. Sandmaier and R. Zengerle, "Highly Parallel and Accurate Nanoliter Dispenser for the High-Throughput-Synthesis of Chemical Compounds", 2001, pages 115-124, in the following referred to as [1], P. Koltay, B. Birkenmaier, R. Steger, H. Sandmaier and R. Zengerle, "Massive Parallel Liquid Dispensing in the Nanoliter Range by Pneumatic Actuation", H. Borgmann, Ed. Bremen: 2002, pages 235-239, in the following referred to as [2], and P. Koltay and R. Zengerle, "Non-contact nanoliter & picoliter liquid dispensing", in *Proceedings of the* 14$^{th}$ *International Conference on Solid-State Sensors, Actuators and Microsystems* (*Transducers & Eurosensors* '07) Lyon, France: 2007, pages 125-129, in the following referred to as [4].

New fields of applications are constantly evolving. One of the most recent fields of application is three-dimensional printing, in particular for building prototypes. Thereby, on the one hand, binder can be printed on thin powder layers, or the building medium can be dispensed directly in liquid form and cured at the target. The latter can also be performed with melting, for example of polymers or metals, which are then cured by cooling at the target. Thereby, for example, printed circuit boards (PCB) can be printed directly.

In dosing systems, the following two dosing mechanisms can basically be distinguished:

contact dosage non-contact dosage

In contact dosage, a media-carrying tool comes so close to the target area that a liquid drop of the medium at the tip of the tool comes into contact with the target area. By the adhesive forces between liquid and target area, part of the liquid remains on the target area when the tip moves away again.

In non-contact dosage, by introducing kinetic energy, a drop is ejected from a reservoir, frequently by means of a nozzle, and accelerated towards the target area. When impinging on the target area, it adheres again due to the adhesive forces.

The advantage of non-contact dosage is that smaller drops can be deposited on a target area from a certain distance. In contact dosage, the tool, frequently a needle, has to be brought so close to the target area that the drop touches the same, hence the smallest distance is approximately in the range of the drop diameter. Miniaturization necessitates, on the one hand, smaller needles, since the same have to be smaller than the drop to be generated, and, on the other hand also decreasing distances. The needles are constantly at a high risk of being damaged. This risk is even increased when dosing has to be performed in areas that are not topographically even.

In non-contact dosage, again, different methods can be distinguished:

open-jet tear-off inertia-driven single drop dosage shock wave method pre-dosing method In open-jet tear-off, a continuous liquid jet is generated out of a small nozzle. Due to energetic conditions, as they are described, for example in the expert publications by P. G. de Gennes, F. Rochard-Wyart and D. Quere, *Capillarity and Wetting Phenomena: Drops, Bubbles, Pearls, Waves*. New York: Springer, 2003 in the following referred to as [4], and L. Rayleigh, "On the Instability of Jets", in *Proceedings of the London Mathematical Society* 1878, in the following referred to as [5], the jet disintegrates into drops of the same size and interval after a certain length.

When the resulting continuous stream of drops is not desired, the jet and hence the drops can be electrostatically charged within the nozzle and derived in the further course by applying electric fields and positioned, for example, on the target area. The disintegration into single drops is increased by the surface tension of liquid and decelerated by the viscosity of the liquid. Hence, this is also the disadvantage of the method. The jet disintegration depends heavily on the viscosity, such that the same no longer functions in a feasible manner with highly viscous media.

In the inertia-driven generation of single drops, the liquid in a nozzle is accelerated by means of a pressure pulse. This introduces kinetic energy into the liquid. If the same is large enough, a liquid drop tears off after the termination of the pressure pulse. Thereby, at first, part of the liquid is pressed out of the nozzle. This part is drawn back into the nozzle due to the surface tension and the negative pressure resulting in the nozzle when the pressure pulse is terminated. The inserted inertia energy stabilizes the drop at first outside the nozzle. On the one hand, the surface tension draws the drop back, but results, on the other hand, in instability of the resulting constriction as in jet decomposition, which can result in a pinch-off of single drops. When this pinch-off takes place before the outer drops change their direction of motion, a drop tear-off from out of the nozzle takes place still with finite speed.

Thereby, single drops with diameters in the order of the nozzle radius can be generated, as described in the expert publication by T. Lindermann, "Droplet Generation—From the Nanoliter to the Femtoliter Range". PhD Dissertation, Institut für Mikrosystemtechnik (IMTEK) Lehrstuhl für Anwendungsentwicklung, Fakultät für Angewandte Wissenschaften Albert-Ludwigs-Universität Freiburg, 2006, in the following referred to as [6].

Another disadvantage is that the pinch-off of the drop becomes slower with increasing viscosity, and the functionality with respect to drops that are as small as possible is limited by the nozzle radius.

In shock wave methods, an acoustic shock wave is generated in the nozzle, which moves towards the end of the nozzle and there also tears off a drop by inertia effects and accelerates the same away from the reservoir. An advantage of the method is the option of generating drops that are smaller than the nozzle diameter. Additionally, the direction of the drop flight does not have to correspond to the nozzle main axis, but corresponds rather to the direction of the shock wave inside the nozzle.

One option of influencing the drop size of a drop to be dosed is pre-dosage within the nozzle system. There, a defined nozzle part is pre-filled, for example by capillary forces and then completely discharged by a subsequent pressure pulse. Thereby, a single drop is formed, which moves towards the target area. An advantage of the method is that the drop size essentially only depends on the nozzle geometry. Any amount of energy can be introduced, such that media of diverse surface tensions and viscosities can be dosed. See, for example expert publications: R. Steger, B. Bohl, R. Zengerle and P. Koltay, "The dispensing well plate: a novel device for nanoliter liquid handling in ultra high-throughput screening", *Journal of the Association for Laboratory Automation*, Vol. 9, No. 5, pages 291-299, October 2004, in the following referred to as [7], P. Koltay, R. Steger, B. Bohl and R. Zengerle, "The dispensing well plate: a novel nanodispenser for the multi-parallel delivery of liquids (DWP Part I)", *Sensors and Actuators A-Physical*, Vol. 116, No. 3, pages 483-491, October 2004, in the following referred to as [8], and P. Koltay, J. Kalix and R. Zengerle, "Theoretical evaluation of the dispensing well plate method (DWP Part II)", *Sensors and Actuators A-Physical*, Vol. 116, No. 3, pages 472-482, October 2004, in the following referred to as [9].

A fundamentally different form of drop generation is spraying. No single drops are specifically dosed, but a spray cone of drops with an opening angle of frequently more than 10° is generated. Such methods are frequently used for extensive application of coatings. Thereby, particles of a material, e.g. a metal, can at first be transported with a gas jet, and then melted by introducing energy during flight, to be solified again as a layer at the target. Such methods are referred to as thermal spraying, which is described in more detail in DIN EN ISO 2063. Thermal spraying is generally also used for coatings.

CA 2 373 149 A1 describes a method for thermal spraying, where by aerodynamic flow focusing the width of the jet in the target is limited to about one tenth of the diameter of the exit opening of approximately 100 μm. The particles are fused by a laser beam and solidify in the target. The drops applied in that manner can also be thermally post-processed by means of the laser at the target, for example for improving the anchoring of the layer. The method is also commercially offered for three-dimensional printing (company Optomec, brand name $M^3D$). Thereby, the distance of the nozzle to the substrate is approximately 5 mm. Structures up to a height of 150 μm can be built, with layer thicknesses in the range of below 100 nanometer up to several micrometer. It is a disadvantage of this method that no single drops can be dosed therewith, and the feature sizes are too small, for example for metallic mold making.

When developing dosing systems, different requirements for the dosing technology by means of non-contact dosage result. Thereby, the following requirements are fulfilled by many dosing methods:

a) high reproducibility with regard to the dosing position
b) high reproducibility of the drop volume
c) high dosing velocity.

Above that, in particular when dosing liquid media, the following requirements still show need for development:

d) non-contact dosage of relatively highly viscous media
e) non-contact dosage of melted media at high temperatures
f) further reduction of the dosage volume.

One example for non-contact dosage of melted media at high temperatures is described in the expert publication by B. Lemmermeyer, "Ein hochtemperaturbeständiger Einzeltropfenerzeuger für flüssige Metalle", Technische Universität München, 2006, in the following referred to as [11].

In drop generation by means of flow focusing, two different non-mixable fluids flow in parallel, generally from different nozzles. Thereby, the secondary fluid surrounds the primary fluid. Since the fluids are not mixable, an interface forms between the same. Corresponding to the above described open-jet disintegration, this interface is energetically unstable and generation of single drops of the inner medium is forced. By constrictions of the channel cross section, where the two media stream in parallel, the "stream" of the inner fluid is also constricted. Thereby, the distance between two occurring drops that is proportional to the radius of the beam according to [4; 5] decreases continuously until drop tear-off occurs. Thereby, the drop size is mainly defined by geometry, while the tear-off frequency is determined by the given flow rates. Since constricting the jet is supported by the common flow of media, drops can also be generated from media having a relatively high viscosity, as described in the following expert publications: L. Anna, N. Bontouc and H. A. Stone, "Formation of dispersions using "flow focusing" in microchannels", *Applied Physics Letters*, Vol. 82, No. 3, pages 364-366, January 2003, in the following referred to as [12], S. Okushima, T. Nisisako, T. Torii and T. Higuchi, "Controlled production of monodisperse double emulsions by two-step droplet breakup in microfluidic devices", *Langmuir*, Vol. 20, No. 23, pages 9.905-9.908, November 2004, in the following referred to as [13], M. Orme, "On the Genesis of Droplet Stream Microspeed Dispersions", *Physics of Fluids A-Fluid Dynamics*, Vol. 3, No. 12, pages 2.936-2.947, December 1991, in the following referred to as [14], and S. Suginra, M. Nakajima and M. Seki, "Prediction of droplet diameter for microchannel emulsification", *Langmuir*, Vol. 18, No. 10, pages 3.854-3.859, May 2002, in the following referred to as [15].

If the secondary fluid is a liquid, drops or gas bubbles are generated embedded in a liquid phase. Such devices are used for generating emulsions, but also for generating samples on microfluidic chips or generation of foams. Thereby, several stages can be connected in series for obtaining any interlacings of drops [13]. By embedding in liquid, drops generated in that manner cannot be accelerated further directly towards a solid substrate. Additionally, a closed liquid system is necessitated for handling the drops.

Methods where the primary fluid is a liquid and a secondary fluid is a gas are not known.

SUMMARY

According to an embodiment, a device for generating a drop of a primary liquid may have: a reservoir fillable with the primary liquid, a pressure generation device for generating a pneumatic or hydraulic pressure on the primary liquid in the reservoir, at least one inlet channel for introducing a secondary fluid, and a channel having a flow cross-section transverse to a main flow direction, wherein the channel is a two-phase channel and the flow cross-section includes a main region and at least one sub-region extending from the main region, designed such that the primary liquid as first phase of the two-phase channel can be held in the main region by capillary forces, and the secondary fluid as second phase of the two-phase channel can be held in the sub-region by capillary forces, wherein the reservoir is fluidically connected to a first end of the channel via an output opening, and the at least one inlet channel is also fluidically connected to the channel, and wherein the pressure generation device is implemented to apply in the reservoir a pneumatic or hydraulic pressure to the primary liquid, whereby the same is moved along the channel and output at a second end of the channel as free-flying drop.

According to another embodiment, a method for generating a drop of a primary liquid by means of a device may have: a reservoir fillable with the primary liquid; at least one inlet channel for introducing a secondary fluid, and a channel having a flow cross-section transverse to a main flow direction, wherein the channel is a two-phase channel and the flow cross-section has a main region and at least one sub-region extending from the main region, implemented such that the primary liquid as first phase of the two-phase channel can be held in the main region by capillary forces, and the secondary fluid as second phase of the two-phase channel can be held in the sub-region by capillary forces, wherein the reservoir is fluidically connected to a first end of the channel via an output opening, and the at least one inlet channel is also fluidically connected to the channel; the method may have the steps of: filling the reservoir with the primary liquid; and applying a pneumatic or hydraulic pressure to the primary liquid in the reservoir, whereby the same moves along the channel and is output as free-flying drop at a second end of the channel.

One embodiment of the present invention provides a device for generating a drop of a primary liquid, comprising: a reservoir fillable with the primary liquid, a pressure generation device for generating a hydraulic pressure on the primary liquid, at least one inlet channel for introducing a secondary fluid, and a channel having a flow cross-section transverse to a main flow direction, wherein the flow cross-section comprises a main region and at least one sub-region extending from the main region, designed such that the primary liquid can be held in the main region by capillary forces, and the secondary fluid can be held in the sub-region by capillary forces, wherein the reservoir is fluidically connected to a first end of the channel via an output opening, and the at least one inlet channel is also fluidically connected to the channel (120), and wherein the pressure generation device is implemented to apply a hydraulic pressure to the primary liquid, whereby the same is moved along the channel and output at a second end of the channel as free-flying drop.

A further embodiment of the present invention provides a method for generating a drop of a primary liquid by means of a device comprising: a reservoir fillable with the primary liquid; and a channel (120) having a flow cross-section transverse to a main flow direction, wherein the flow cross-section comprises a main region and at least one sub-region extending from the main region, designed such that the primary liquid can be held in the main region by capillary forces, and the secondary fluid can be held in the sub-region by capillary forces, wherein the reservoir is fluidically connected to a first end of the channel via an output opening, and the at least one inlet channel is also fluidically connected to the channel.

Hence, embodiments of the present invention also provide a device and a method for generating liquid drops by two-phase flow. Thereby, the embodiments allow dosing of drops of a liquid primary fluid or drops of a primary liquid by ejection from a nozzle or a channel. Further, embodiments are implemented to cause the drop tear-off or the drop generation already within the nozzle or within the channel by a fluid flow of a secondary fluid or drive fluid at least partly surrounding the primary liquid.

Further, embodiments have a nozzle or a channel where, in a correct configuration, the primary fluid can only be in the main region of the channel due to the capillary forces.

Further embodiments comprise a star-shaped nozzle or a star-shaped channel where the main region is arranged in the center and is surrounded by sub or peripheral regions adjacent to the main region, and wherein the primary fluid—in a correct configuration—can only be in the main or central region due to the capillary forces.

Embodiments of the present invention are based on drop generation by means of two-phase flow or a two-phase channel. A similar method of drop generation is the above described flow focusing. Essentially, the methods of flow-focusing can be distinguished based on the secondary fluid and the primary fluid that are flowing out:

primary fluid and secondary fluid are liquids, primary fluid is a gas, secondary fluid is a liquid, and primary fluid is a liquid and secondary fluid is a gas.

Examples of flow focusing where the secondary fluid is a liquid have already been discussed above with reference to [13]. If the secondary fluid is a gas, drop tear-off caused by the constriction of the primary fluid and supported by the secondary fluid would take place. However, conventional examples of this application are not known.

In the method of thermal spraying also discussed above, aerodynamical flow focusing can also be used for constricting the spray cone, however, the same is not used for generating the drop itself.

BRIEF DESCRIPTION OF THE DRAWINGS

Embodiments of the present invention will be detailed subsequently referring to the appended drawings, in which.

DETAILED DESCRIPTION OF THE INVENTION

In the figures, the same reference numbers are used for the same or for equal or similar features or functional units.

For the term primary liquid, the terms primary fluid, primary phase or primary medium are used as well, and for the term secondary fluid, the terms secondary medium or drive fluid or, depending on the embodiments, also secondary gas are used as well.

Embodiments of the device for generating a drop can thereby be used as dosing apparatus or dosing device, for example for non-contact dosage of liquids. Wherein liquids can, for example, also be melted polymers or metals.

Figure 1A:
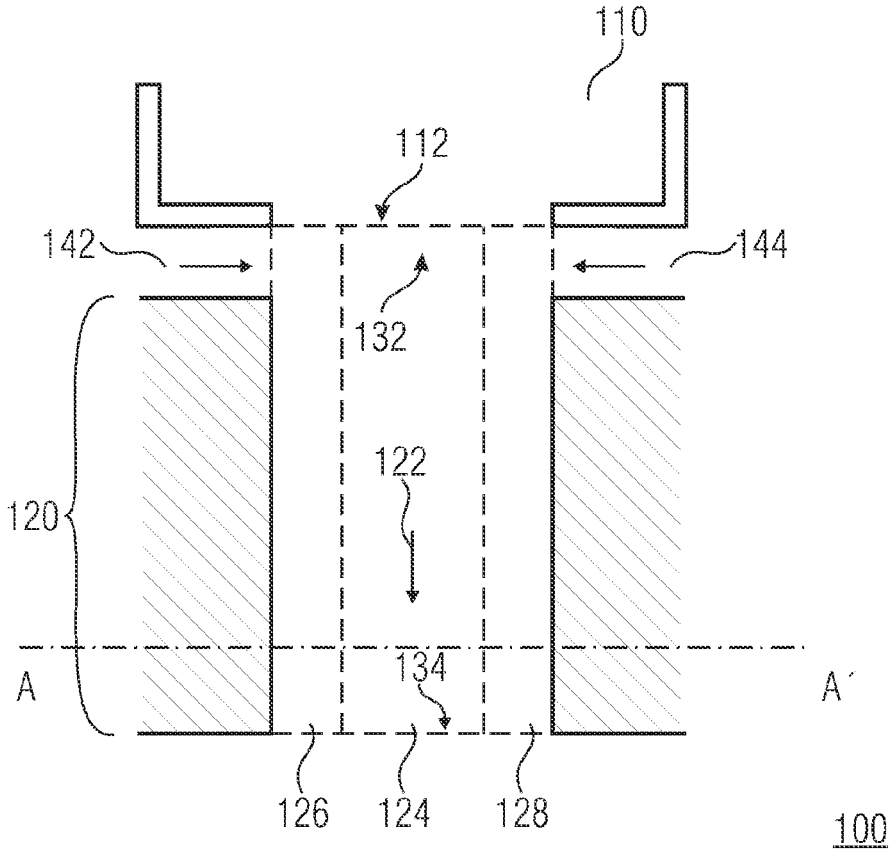
FIG. 1A shows a schematic longitudinal section of an embodiment of a device for generating a drop of a primary liquid.
Figure 1B:
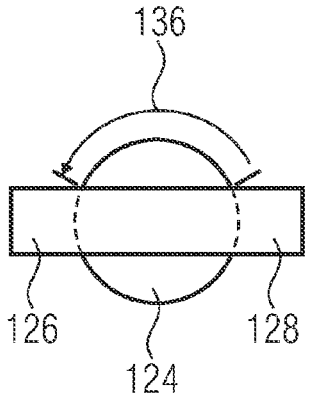
FIG. 1B shows a cross section A-A' of a first embodiment of a channel for a device according to FIG. 1A.

FIG. 1A shows a schematic longitudinal section of an embodiment of a device 100 for generating a drop of a primary liquid having a reservoir 110 and a channel 120. FIG. 1B shows a schematic cross-section A-A' of the device 100 according to FIG. 1A or a flow cross-section transverse to a main flow direction (see arrow with reference number 122) of a secondary fluid, wherein the flow cross-section comprises a main region and two sub-regions 126, 128 extending to the outside from the main region 124.

Thereby, the channel 120 is implemented such that the primary liquid having a first wettability with respect to a material of the channel 120 can be held in the main region 124 by capillary forces, and the secondary fluid having a second wettability with respect to the material of the channel 120 in the case of a secondary liquid, which is higher than the first wettability, can be held in the sub-region or sub-regions 126, 128 by capillary forces. In the case of a secondary gas, the first wettability of the primary liquid is such that a contact angle of the primary liquid with respect to the material of the channel 120 is more than 90°. This type of two-phase channel, where the primary liquid forms the first phase and the secondary fluid forms the second phase, will be discussed in more detail below.

At a first end 132, the reservoir 110 is fluidically connected to the channel 120, in this case to the main region 124 and the sub-regions 126, 128, by a first opening, which can also be referred to as output opening. At the second end of the channel 134 opposing the first end, for example, the generated drop of the primary liquid can be output, the generation of which will discussed in more detail.

Further, the device 100 for generating a drop comprises a first inlet channel 142 and a second inlet channel 144 for supplying the secondary fluid (see arrows in the inlet channels 142, 144). The inlet channels 142, 144 are fluidically connected to the channel 120 at the first end 132 of channel 120. Thereby, the inlet channels can be directly fluidically connected to the sub-regions, i.e., the first inlet channel 142 can directly lead into the first sub-region 126, and the second inlet channel 144 directly into the second sub-region 128.

In the embodiment shown in FIG. 1A, the inlet channels lead into the channel 120 perpendicular to the main flow direction 122 of the channel 120. However, in alternative embodiments the same can also lead into the channel 120 parallel to the main flow direction 122, or in any other angles to the same. Embodiments comprise inlet channels 142, 144 having an angle between 45° and 135° or 70° and 110° with regard to the main flow direction.

In the embodiment of the device 100 shown in FIG. 1A, the first opening 112 of the reservoir 110 has the same diameter as the cross-section of channel 120. In alternative embodiments, the diameter or the dimensions of the first opening 112 can, for example, also be smaller than the size of the cross-section of the channel 120 and can, for example, have the dimensions of the cross-section of the main region 124. In the following, embodiments of the channel 120 or the two-phase channel 120 will be discussed in more detail.

Two fluids, i.e., liquids or gases, form a two-phase system when the two fluids are immiscible. The interfaces between two different phases are called phase interfaces, wherein phase interfaces are not only formed between, for example, the above mentioned primary fluid and secondary fluid, but also between the primary fluid or secondary fluid and the channel 120. Particularly at the last mentioned interfaces, so-called capillary effects can occur, which are based on the molecular forces occurring within a substance (cohesion forces) and at the interface between a fluid and another fluid or a solid body (adhesive forces).

Thereby, a so-called capillary rise occurs with fluids "wetting" the material of the so-called capillary, such as water on glass or in a small glass tube as capillary. The water rises in this glass tube and forms a concave surface (meniscus). This behavior is based on the adhesive force, i.e., the force acting between water and glass.

In other words, in capillary rise (wetting fluid), the contact angle between the wall of the capillary and the fluid surface forms an angle of less than 90°.

The so-called capillary depression occurs when the fluid does "not wet" the material of the capillary. Examples of this are mercury on glass or water on glass having a lubricated surface. Such fluids have a lower level in the capillary than in the environment and a convex surface. The contact angle is more than 90° (non-wetting fluid).

The smaller the diameter or cross-section of the capillary, the higher the capillary pressure and the rise, wherein the capillary rise (wetting fluid) causes a positive capillary pressure and a positive rise, and the capillary depression (non-wetting fluid) causes a negative capillary pressure and a negative rise.

With reference to the design of the channel 120, the effect or ability of the channel to hold the primary fluid in the main region 124 depends also on whether in the case of a secondary liquid as secondary fluid the primary fluid has a smaller wettability with respect to the material of the channel 120 than the secondary fluid.

Thereby, in the case of liquids, a fluid has a higher or larger wettability with respect to another fluid when the fluid has a wetting characteristic with respect to the material of the capillary, and the other fluid has a non-wetting characteristic, and, if both fluids have a wetting characteristic, the fluid has a smaller contact angle than the other fluid.

Thereby, the wettability depends on all three phases, i.e., the material of the capillary, the liquid in the capillary and the third phase, typically a gas such as air. The influence of the gas on the wettability or the contact angle of the liquid is negligible, such that generally a wettability of a liquid with respect to fixed material is addressed, i.e., in the context of this application, a first wettability of the primary liquid and a second wettability of the secondary liquid with respect to the material of the channel 120.

In contrary to liquids, with gases, there is generally no reference to wettability. Thus, channels 120 of embodiments of the device for generating a drop of a primary liquid, where a gas is used as secondary fluid or secondary gas, are implemented such that a contact angle of the primary liquid with regard to the material of the channel 120 is more than 90°, in order to hold the primary liquid in the main region by capillary forces. In further embodiments, the material of the channel is selected such that the contact angle of the primary liquid with regard to the material of the channel is more than 110°, more than 130° or even more than 150° in order to increase the capillary effect and the ability of the channel to hold the primary liquid in the main region.

In further embodiments, the channel 120 or the cross-section of the channel 120 is implemented such that a contact line between the primary liquid guided in the main region and the channel 120 or channel interface perpendicular to the main flow direction (i.e., in the cross-section) is very small, such that the flow resistance of the primary fluid is also significantly reduced. Thereby, moving the primary fluid, or, after tearing off of the drop, the drop itself is also possible even at very small forces, for example small pressures or flow velocities. In FIG. 1B, the upper part of the contact lines is exemplarily illustrated by the arrow and the reference number 136. The whole contact line in the embodiment according to FIG. 1B results from the partial contact line 136 and the respective partial contact line on the lower side of the channel between sub-regions 126 and 128.

In embodiments of the channel 120 as shown, for example, in FIG. 1B, the sub-regions 126, 128 are also referred to as fingers or peripheral regions and the main region 124 also as a central region arranged in the center of the fingers or peripheral regions. Thereby, the main region 124 can have any shape but, however, preferably has a circular shape in order to allow a cross-sectional periphery (periphery perpendicular to the main flow direction) of the primary fluid that is as small as possible. As an alternative to the shown rectangular cross-sectional shape, the sub-regions 126, 128 can also be triangular or can be implemented in another symmetrical or asymmetrical shape. Further, embodiments of the device 100 for generating can have two sub-regions 122, 128, as illustrated in FIG. 1B, or only one sub-region or more than two sub-regions, wherein the sub-regions can, again, be distributed evenly or unevenly across the periphery of the main region. Thereby, the main region and the one or several sub-regions can also have, for example, a T-shape or an L-shape.

Figure 2A:
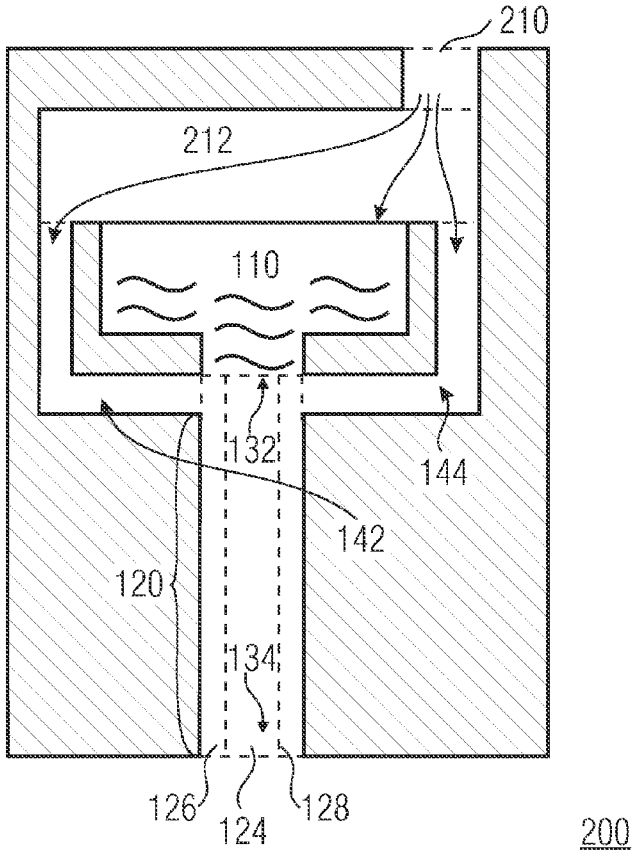
FIG. 2A shows a schematic longitudinal section of a further embodiment of the device for generating a drop having a feed line for the secondary fluid fluidically connected to the reservoir for the primary liquid and also to the inlet channels for the secondary fluid.
Figure 2B:
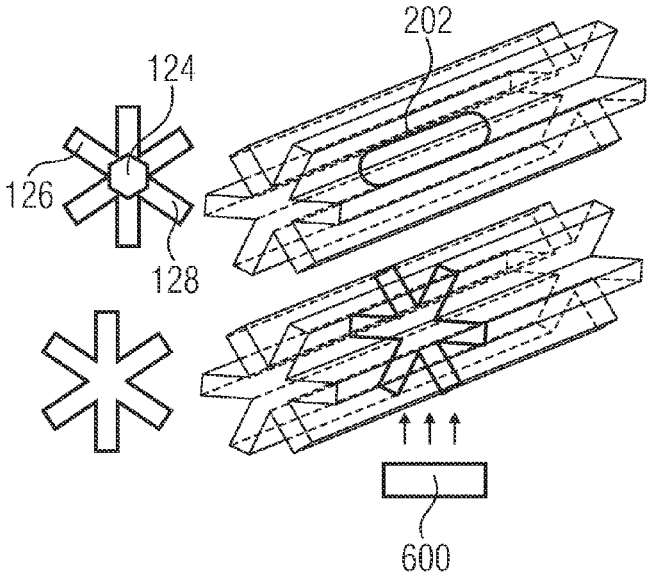
FIG. 2B shows an embodiment of a star-shaped channel having six fingers as an embodiment of a flow cross-section of the channel of a device according to FIG. 2A.

FIG. 2B shows a schematic longitudinal section of a device for generating a drop of a primary liquid having, compared to the embodiment 100 in FIG. 1A, a feed line 210 for the secondary fluid, which is again fluidically connected to the reservoir 110 for the primary liquid and the individual inlet channels for the secondary fluid (see the three arrows starting from the feed line 210). In other words, the gas feed line 210 is implemented such that the same is in direct fluidic contact both with the gas inlet channels 142, 144 and the liquid reservoir 110 via the fluidic connection 212 and the same pressure can be applied to an input region of the inlet channels 142, 144 and also to an inlet opening of the reservoir 110—arranged at the top in FIG. 2A.

FIG. 2B shows a form of a channel 120 having a star-shaped channel cross-section, wherein the star-shaped cross-section comprises a main region 124 and six sub-regions or fingers, wherein, as an example, two are designated with reference numbers 126, 128 (as representatives for the others). Such star-shaped channel cross-sections are also used in so-called "StarTubes", where gas bubbles are guided in a surrounding liquid by the star-shaped implementation of the channel cross-section with almost vanishing contact line—perpendicular to the direction of motion of the gas bubble, as described in T. Metz, W. Streule, R. Zengerle and P. Koltay, StarTube: A Tube with Reduced Contact Line for Minimized Gas Bubble Resistance 2008, Volume 24/No. 17, pages 9204-9206, in the following referred to as [16]. Here, it is described how such a channel cross-section is to be designed with regard to the contact angle resulting from the material of the structure and two fluids within the same, such that a fluid is held in the center of the channel by capillary forces while the other fluid is only in the edge regions.

The contact line 136 or the part of the whole contact line is reduced to a few points where the fingers or sub-regions border on the main region or converge with the same. Thereby, as has already been discussed based on FIG. 18, the resistance against the movement is strongly reduced, and the possibility is given to remove, for example, gas trappings. Thereby, however, the gas trappings typically move in the center of the tube while the wetting liquid is guided at the outer edge.

In comparison, embodiments of the invention are implemented such that, for example, non-wetting liquids, such as liquid metals, are guided as primary liquid in the center or in the main region on most solid surfaces, and the secondary fluid, e.g., a gas, passes in the edge regions or sub-regions 126, 128 of the star-shaped tube or star-shaped channel.

At the top right, FIG. 2B shows a drop 202 of the primary fluid guided in the main region 124 (see dark area of the illustration top left in FIG. 2B), while the secondary fluid can flow around drop 202. FIG. 2B on the bottom right shows a star-shaped channel that can, for example, generally due to its material characteristics, not hold the primary liquid within the main region, or cannot hold the primary liquid in the main region temporarily by the influence of a means 600 for changing the wettability, e.g., by a tempering device that can cause the so-called Maragoni effect, such that the primary fluid extends across the whole cross-section of channel 120 (see dark region in FIG. 2B left bottom, as well as star shape of the primary fluid right bottom).

The ability of the channel to hold the primary fluid, for example, as a drop, in the main region depends on the number of fingers and the wetting characteristics of the material or the contact angles.

With reference to FIG. 2A, an embodiment of the device 200 for generating a drop of a primary fluid is shown, where the reservoir or liquid reservoir 110 is filled with the primary fluid and directly connected to the star-shaped nozzle or the star-shaped channel 120 via an opening 112. Further, close to this opening 112, the outer partial channels or sub-regions (as representatives for all channels reference numbers 126, 128) are connected to gas inlet channels 142, 144 (as representatives for further gas inlet channels). These gas inlet channels 142, 144 are again directly fluidically connected to the gas feed line 210. By applying excess pressure to the gas feed line 210, a gas flow into the environment can be generated by the gas inlet channels 142, 144 via the star-shaped nozzle 120. Thereby, the inner surface of at least the nozzle 120 is designed such that the same cannot be wetted by the primary fluid.

In other words, an embodiment of the device 200 has a reservoir or liquid reservoir 110, gas-carrying inlet channels 142, 144, a feed line 210 for the secondary fluid, e.g., a drive gas, and a star nozzle 120 or generally a channel 120 sufficiently non-wetting for the primary liquid to be dosed.

Based on FIG. 3A-3J, the generation of drops or the different stages of drop generation will be discussed below based on a device 200 for generating a drop according to FIG. 2A. Thereby, a gas is used as secondary fluid in the described embodiment.

Figure 3A:
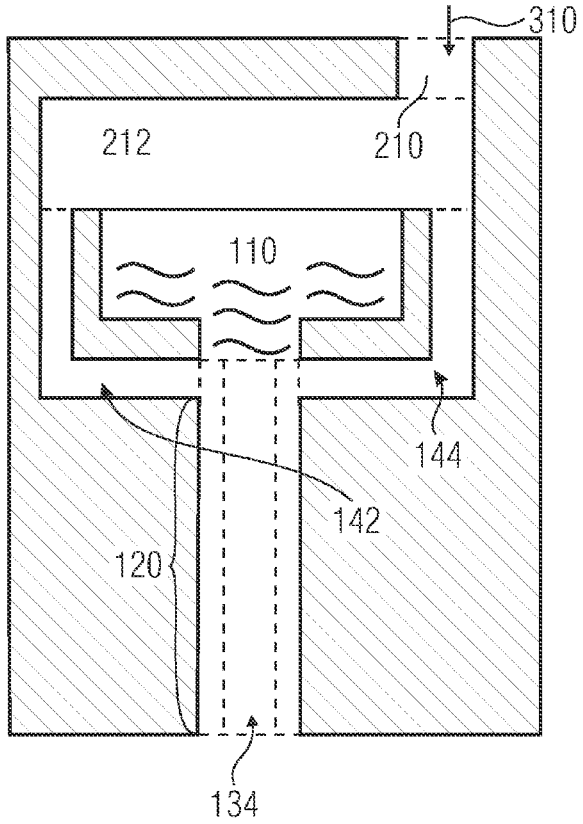
FIG. 3A to 3J show schematically stages of drop generation or steps of an embodiment of a method for generating a drop by means of a device for generating a drop according to FIG. 2A.

FIG. 3A shows the step 310 of the method for generating a drop of the primary liquid which is in the reservoir or liquid reservoir 110. Thereby, in step 310 of application of pressure or gas, a gas pressure is applied by the gas feed line 210, which correspondingly also acts or is applied in the antechamber 212 or generally the fluidic connection 212 between feed line 210 and reservoir 110 or inlet channels 142, 144. In other words, a gas phase exists as a secondary fluid in the gas feed line 210, the fluid connection 212 and the gas inlet channels, while a liquid phase exists as primary fluid in the reservoir 110. The application of gas 310 is performed, for example, during the whole method.

Figure 3B:
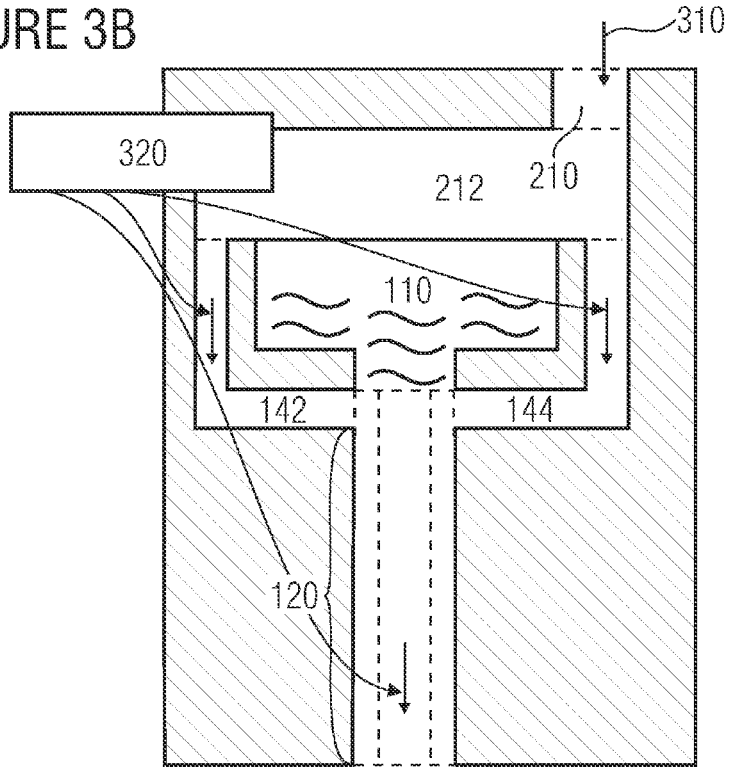

As shown in FIG. 3B, applying the gas pressure 310 results in a gas flow 320 through the gas inlet channels 142, 144 and, hence, in the star-shaped nozzle 120, towards the end of the nozzle 134.

Figure 3C:
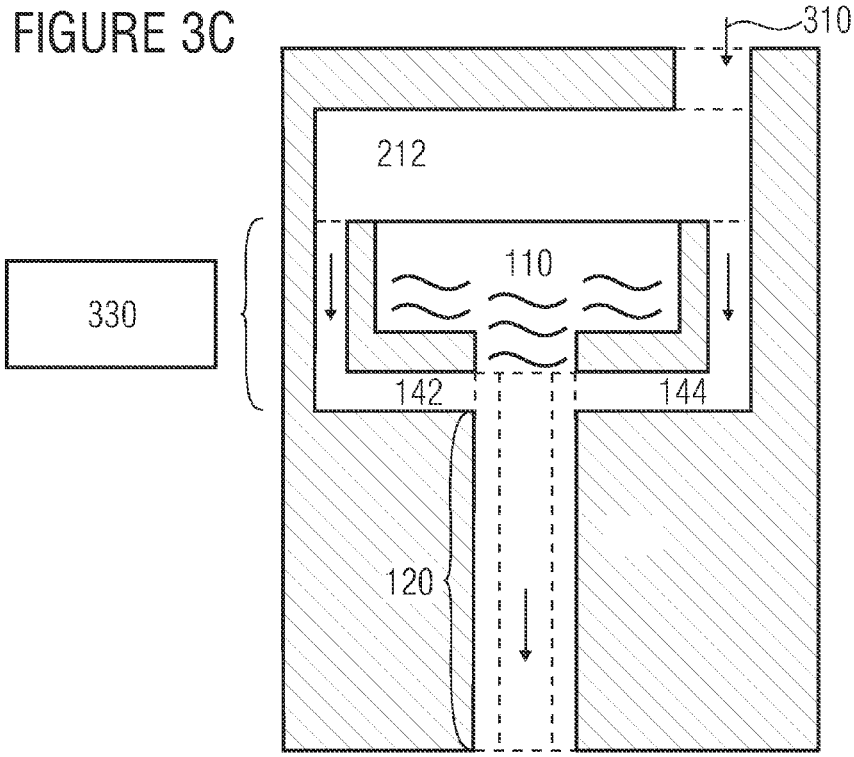

FIG. 3C shows the step 330 of generating or developing a pressure difference between liquid reservoir 110 and nozzle 120. Since pressure loss occurs along the gas inlet channels 142, 144, there is a lower pressure in the nozzle 120 than in the reservoir chamber 110. If this pressure difference is large enough, primary liquid will be moved from the liquid reservoir 110 into the star-shaped nozzle 120 against the capillary pressure, see step 340 in FIG. 3D.

Figure 3D:
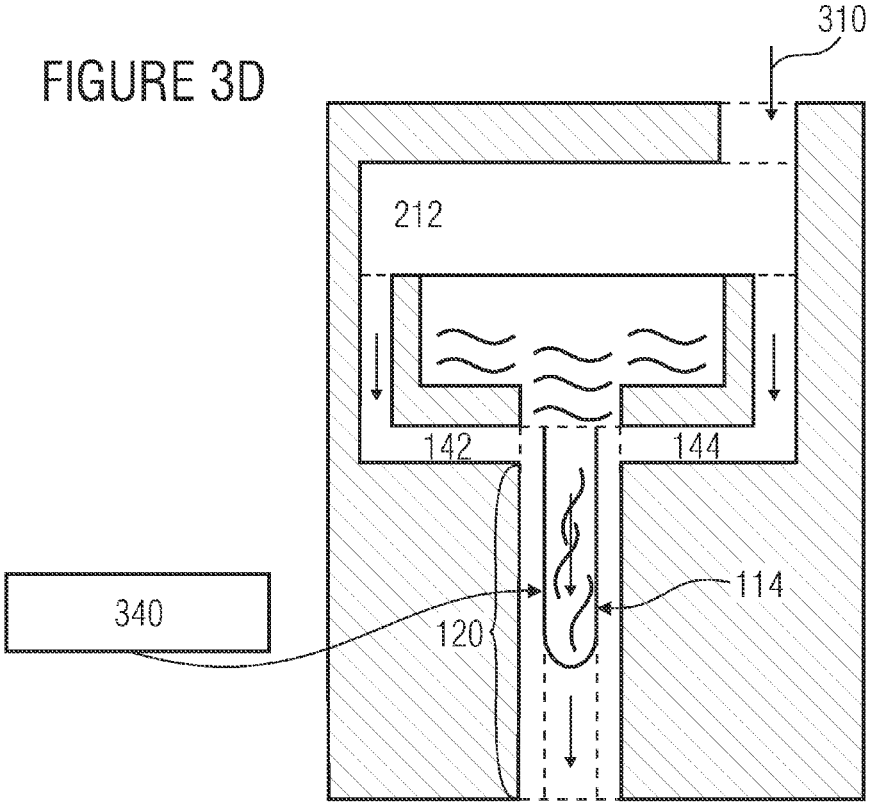
Figure 3E:
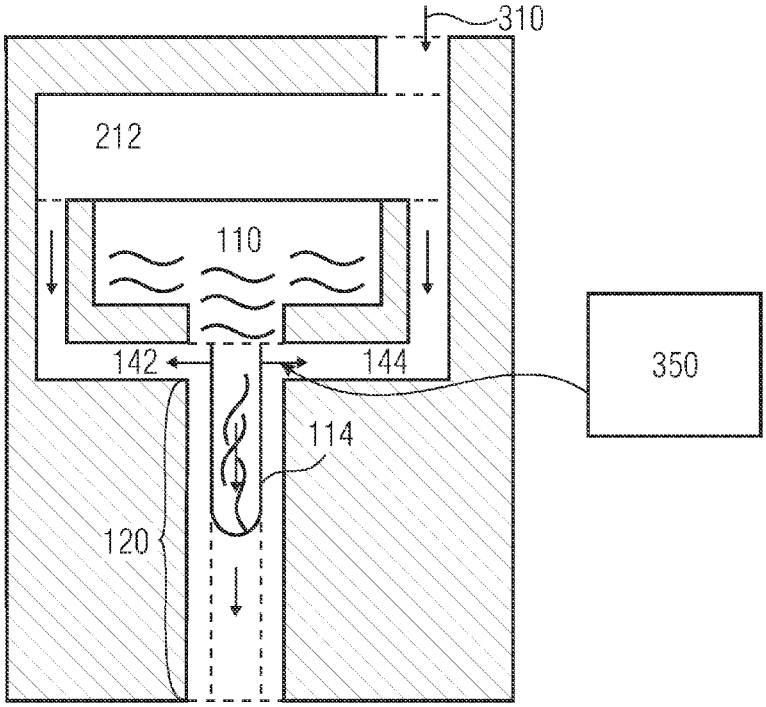

FIG. 3D shows the step 340 of pressing the liquid column 114 into the main region of the nozzle 120. In other words, due to the pressure difference between the pressure in the reservoir 110 and the pressure in the channel 120, part of the primary liquid extends into the channel or spreads into the channel 120. Thereby, as discussed above, for example, the star-shaped nozzle 120 is non-wetting for the primary liquid and implemented such that the liquid only enters into the main region of the channel but not into the peripheral channels or sub-regions 126, 128 as described in [16].

When the primary liquid advances into the star-shaped nozzle, the gas flow—due to the decreasing flow cross-section available for the secondary fluid—is increasingly impeded and pressed into the sub-regions 216, 218 of the star-shaped nozzle 120. This increase of counter pressure at the end of the liquid reservoir or the flow resistance in the channel is shown as step 350 in FIG. 3E (see short arrows starting from liquid column 114 against the closing direction into the inlet channels 142, 144). Since the flow resistance is higher in the sub-regions 126, 128, the gas flow is reduced (see FIG. 3D). Thereby, the gas pressure in the nozzle rises again and will, if the gas flow completely stopped, correspond to the gas pressure at the gas feed line 210 (see FIG. 3E). Thereby, the excess pressure or pressure difference between the liquid reservoir 110 and the channel 120 decreases, until it will no longer be sufficient to feed the liquid further into the nozzle or to hold the liquid column 114 at that magnitude. Now, the capillary pressure draws the liquid column 114 back in the direction of the reservoir 110.

Figure 3F:
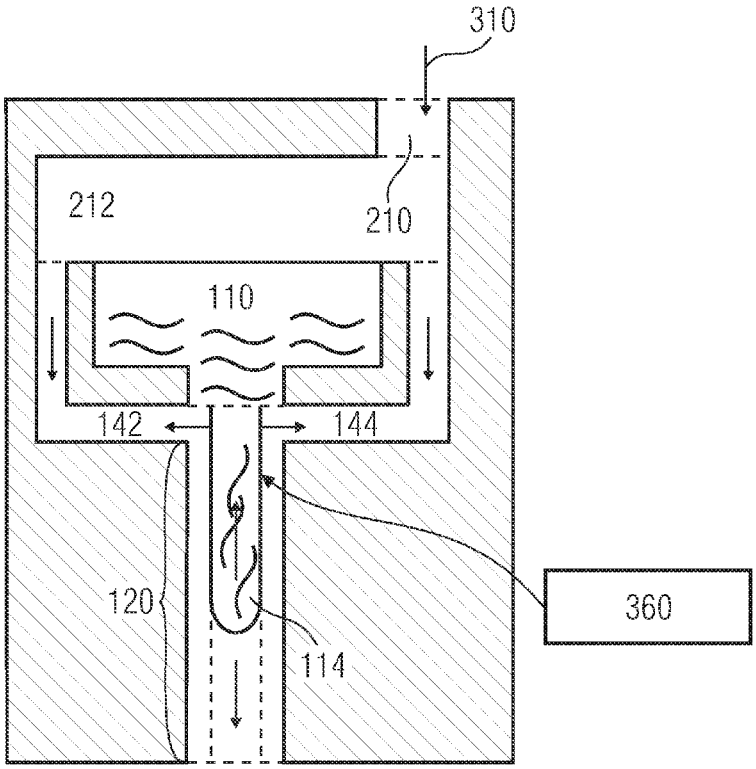
Figure 3G:
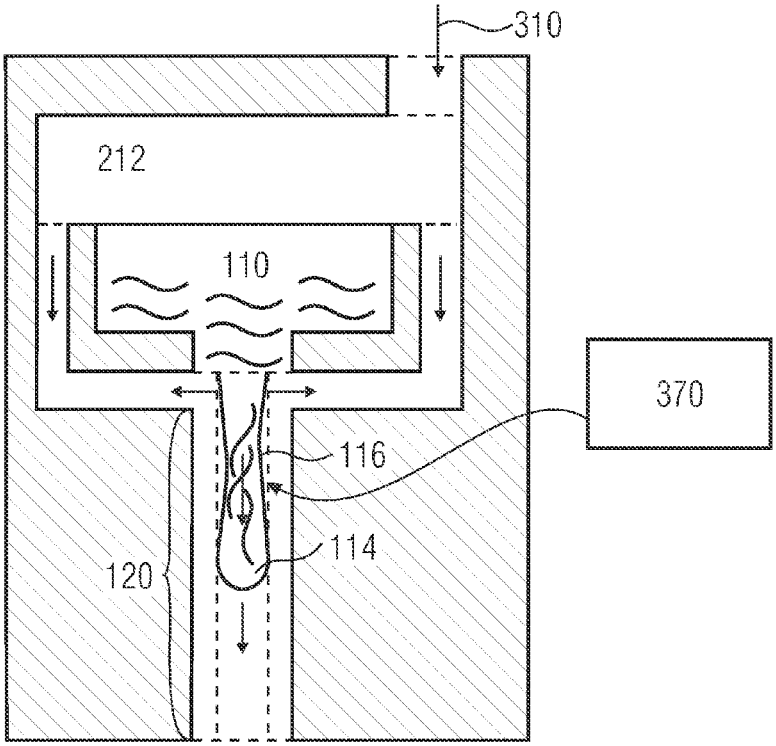
Figure 3H:
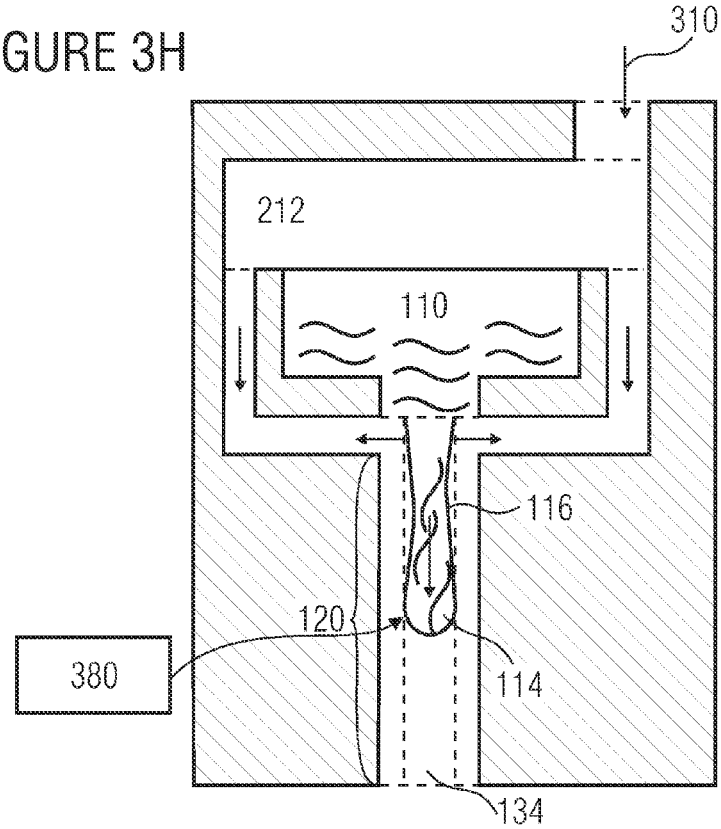

FIG. 3F shows the step 360 of drawing back the liquid column 114 (see also arrow within liquid column 114). Due to the mass inertia of the front liquid volume of the liquid column 114, constriction 116 results within the liquid column, or in the part 116 of the primary liquid extending into the channel. The step or the effect of the constriction 116 caused by the withdrawal is shown in step 370 in FIG. 3G. This effect can also be supported by gravity by arranging the channel of the embodiment directed towards the bottom.

By the effect of the excess pressure in the nozzle 120 on the constriction 116, a force component results on the front part of the liquid column 116 in the direction of the nozzle outlet or channel outlet 134. Thereby, the front part of the liquid column 114 is moved towards the end of the channel 144 and the constriction 116 is increased further. This step or effect of increasing the constriction further due to the gas flow and the force effect caused by the same on the front half of the liquid column 114 is shown in step 380 in FIG. 3H.

Figure 3I:
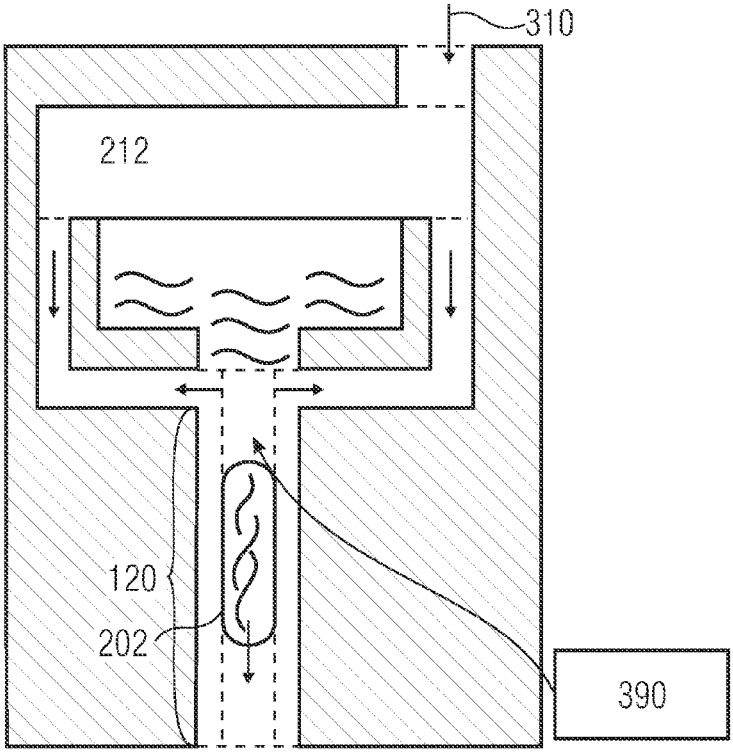

Finally, pinch-off of a drop 202 or tearing off the front part of the liquid column 114 from the residual part of the primary liquid results. In FIG. 3I, the effect or step 390 of tearing off the drop and its guidance out of the channel with the gas flow of the secondary fluid (see arrow at drop 202) is shown. After the drop has been pinched off from the liquid column 114, it will be accelerated out of the nozzle by the excess pressure within the nozzle (see FIG. 3I).

Figure 3J:
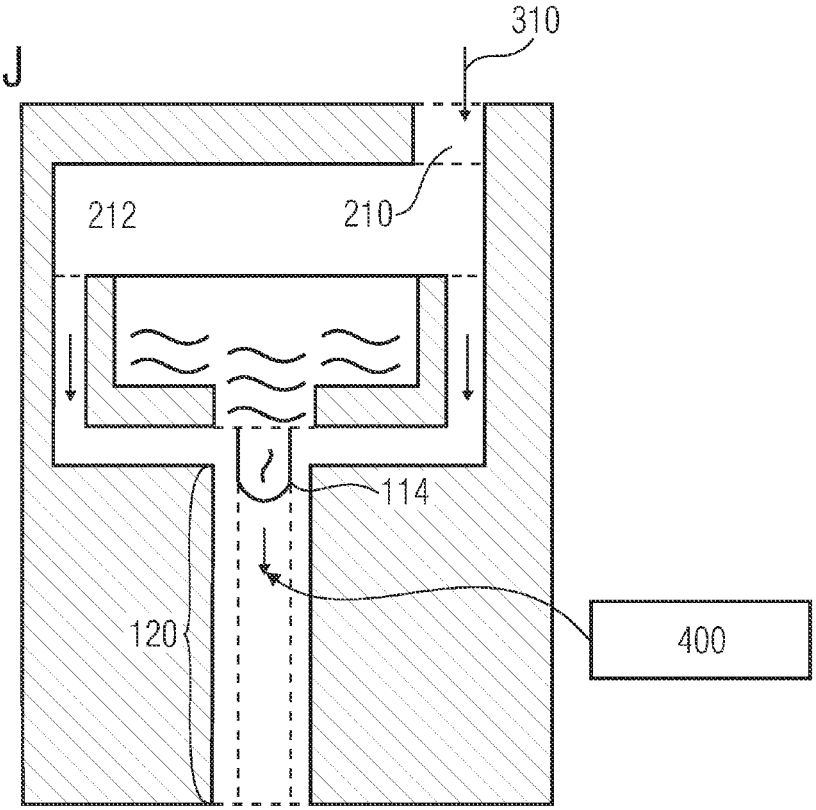

In embodiments with a star-shaped nozzle, the drop only experiences little contact line friction, thus there is only little danger that the drop adheres. Contamination of the outer nozzle plate can mostly be excluded, which again presents a decisive advantage of the method. When the drop has left the nozzle, as long as the excess pressure at the gas feed line 210 is still exists, the primary feed can enter the nozzle again and a new liquid column 114 can be generated. The renewed pressing of a liquid column into the channel is shown in FIG. 3J or step 400. In this case, the cycle starts new and steps or stages FIG. 3A-3I or 3J are cycled through again, until a next drop tears off, as shown in FIG. 3I.

In embodiments of the present invention, the drop volume can mainly be defined by the nozzle structure, since the same causes the constriction by the gas flow or flow of the secondary fluid and hence the tear-off of the drop. Thereby, different options exist for influencing this tear-off in a geometric and/or physical manner. For example, the tear-off pressure can be increased by tapering outer channels.

In a further embodiment, the gas flow can also be realized and controlled independent of the pressure applied to the liquid reservoir 110. For example, as shown in FIG. 1A, the secondary fluid can be applied to the outer inputs of the inlet channels 142, 144 with a specific pressure, while no pressure, atmospheric pressure or another pressure is applied to the primary liquid in the reservoir 110.

Correspondingly, embodiments of the present device can comprise a control or pressure generation device for generating and controlling the pressure generating the pressure, with which the secondary fluid is applied to the feed line 210 in embodiments according to FIG. 2A, and generating the pressure with which the secondary fluid is applied to the inputs of the inlet channels 142, 144 in embodiments according to FIG. 1A, and possibly additionally controls a second pressure applied to the primary liquid in the reservoir 110.

Embodiments of the present invention can comprise a pressure generation device, which is implemented to apply a hydraulic pressure to the primary liquid or to generate a pressure difference between a pressure in the reservoir 110 and a pressure in the channel 120, such that due to the same, the primary liquid extends into the main region 124 of the channel. In one embodiment according to FIG. 2A, the pressure generation device is implemented to generate an amount of the pressure of the same magnitude to the primary liquid in the reservoir 110 and to an input region of the inlet channel 142, 144.

Embodiments of the present invention are implemented such that filling the dosing device or the dosing channel 120 is performed by pneumatic pressure and not—as frequently the case with conventional dosing devices—by capillary forces. Thereby, the problem of filling and bubble-free filling is avoided. This is particularly important when filling liquid metals, since the same do not wet most non-metallic solid body surfaces due to their high surface tension.

Further embodiments are implemented to increase the tear-off pressure also by the length of the nozzle. By an appropriate design of the geometry, i.e. stages in the gas channels, it is also possible to completely define the drop volume by the nozzle geometry, such that the same is not susceptible to variations in actuation independent of the physical characteristics of the medium or fluid and across a wide range. Thereby, the dependency of the dosed volume on the medium or fluid frequently given in dosing methods is also eliminated.

Since the drop tear-off can be amplified by the gas flow or the flow of the secondary fluid, embodiments can further be implemented to also dose media or fluids having higher viscosity than conventional dosing devices, by means of the nozzle geometry, for example, respective channel cross-sections.

By forming the drop 202 within the nozzle 120, wetting the nozzle plate—which has to be performed by appropriate surface coatings and optimizing the ink in conventional methods—is mostly eliminated.

By controlling the pressure pulse or the pressure by which the secondary fluid is applied to the feed line 210 (see FIG. 2A) or generally to the inlet channels 142, 144 (see FIG. 1A), dosage of a single drop can easily be realized, contrary to the conventional methods by means of open-jet tear-off, where a continuous primary fluid jet is necessitated, or conventional spray methods or thermal spray methods also necessitating a continuous fluid or particle jet.

Through the gas feed line 210 or the gas inlet channels 142, 144, gas can flow continuously at low pressure without generating a drop. This is in particular advantageous for dosing melts, as described in [11]. By flow of a non-oxidizing gas, i.e. nitrogen, oxidization of melts, e.g. liquid soldering tin, is avoided. Since the gas flow is continuous, it also maintains the drop surface during the flight prior to oxidation. Since the gas flow comes from the same nozzle, there is—as in other dosing devices—no the danger that the gas flow negatively influences the direction of motion of the drop.

The usage of the secondary fluid for transferring the pressure to the primary fluid and the induction of the drop tear-off as well as protective gas allows a very simple structure and cost-effective drive operation of the system.

Further, by controlling the temperature of the secondary fluid, solidifying of dosed melts as primary fluid during flight can be avoided or influenced. This has the advantage for dosing, i.e. in the rapid prototyping field, that the melt only cures after impinging and hence can melt together with the target or can mechanically anchor itself.

Vice versa, when a liquid gas or a liquid close to the boiling point is to be dosed by the device, evaporation of the medium during flight can be suppressed by a cold gas flow as secondary fluid.

In the following, a test realization of an inventive device or an inventive method is described (based on FIGS. 4A, 4B and 5). Thereby, the test realization has been performed according to an embodiment according to FIG. 2A. The nozzle 120 has been produced as a silicon chip with etched star-shaped nozzle. In a second upper etching, gas inlet channels 142, 144 have been realized.

Figure 4A:
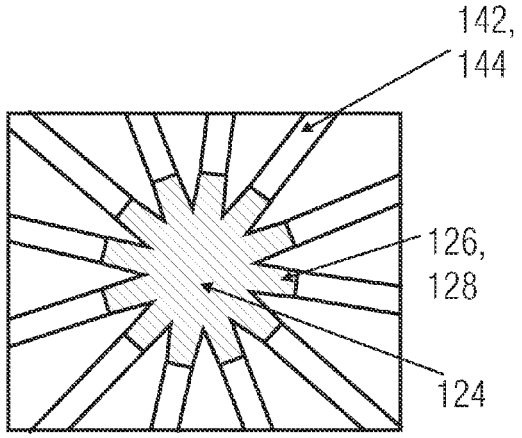
FIG. 4A shows a top view of a silicon chip having a star-shaped nozzle and gas access channels of an embodiment of a device for generating a drop.

FIG. 4A shows a top view of the star-shaped channel cross-section having twelve fingers 126, 128, equally distributed across the periphery of the main region 124 of the channel 120. FIGS. 4A and 4B further show the gas inlet channels 142, 144, each directly leading into the fingers or sub-regions 126, 128 perpendicular to the main flow direction.

Figure 5A:
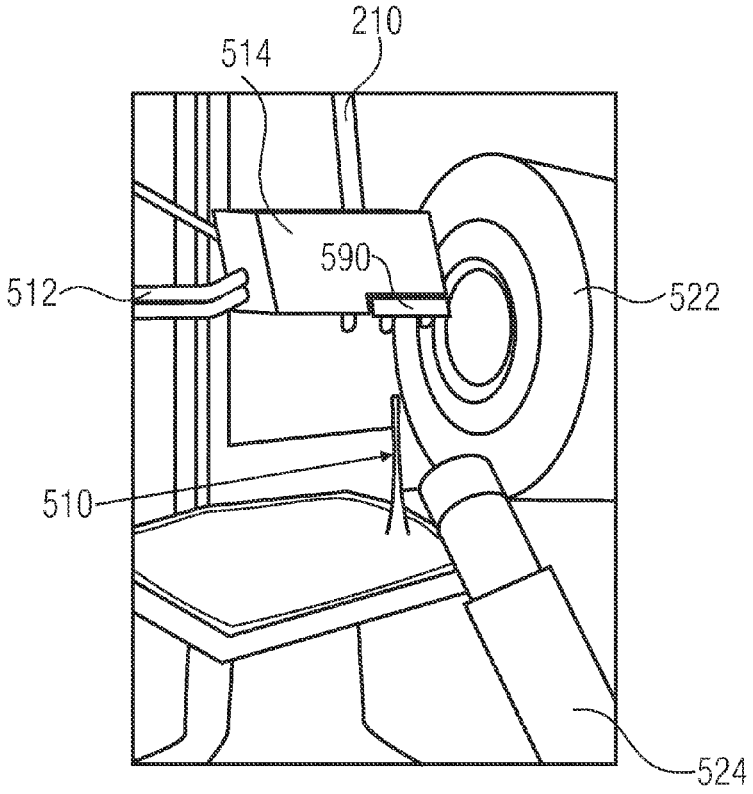
FIG. 5A to 5C show different illustrations of a structured test system for a device for generating a drop and a printed structure of soldering tin drops generated by the structured test system.
Figure 4B:
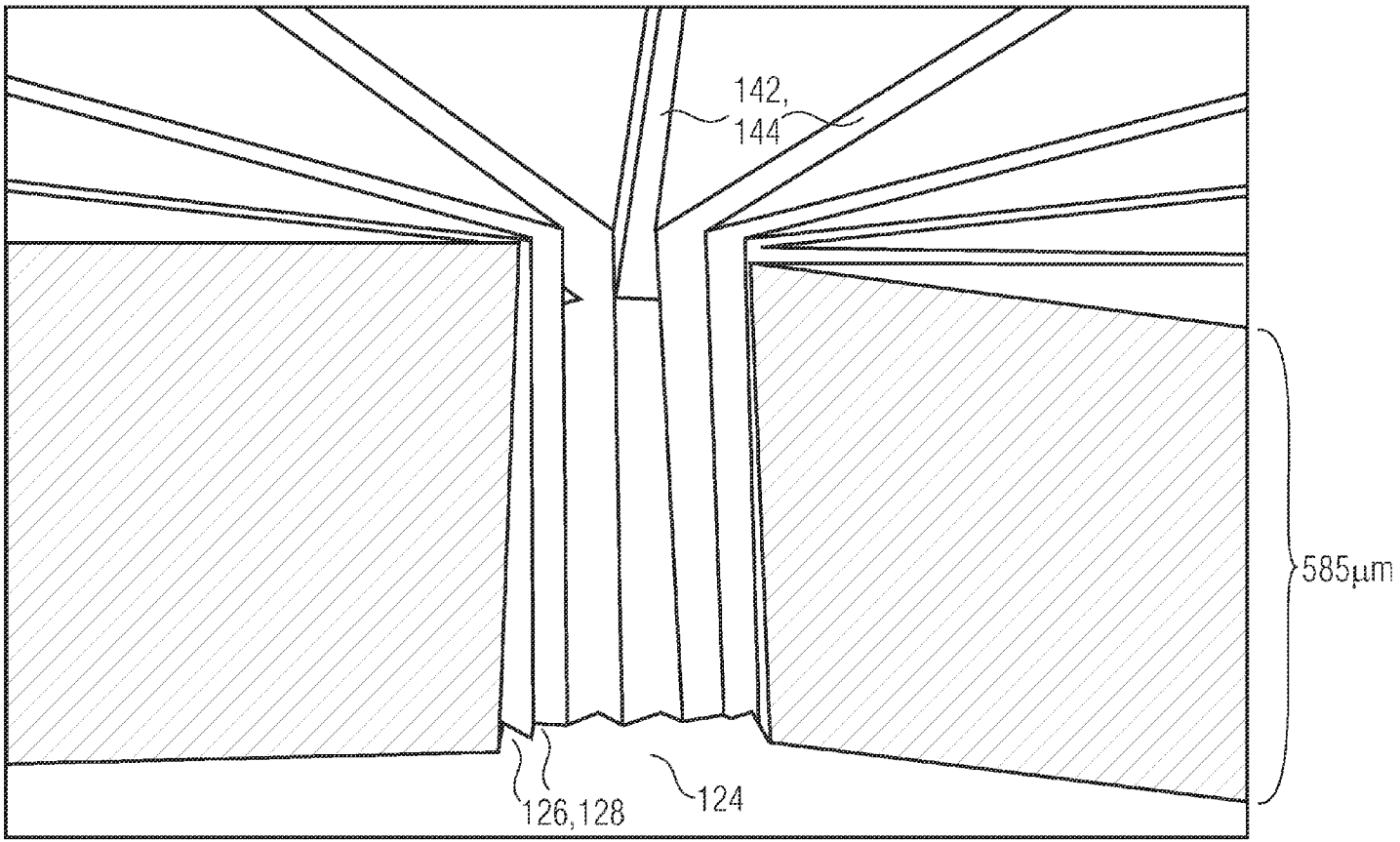
FIG. 4B shows a side view of the broken chip according to FIG. 4A.
Figure 5B:
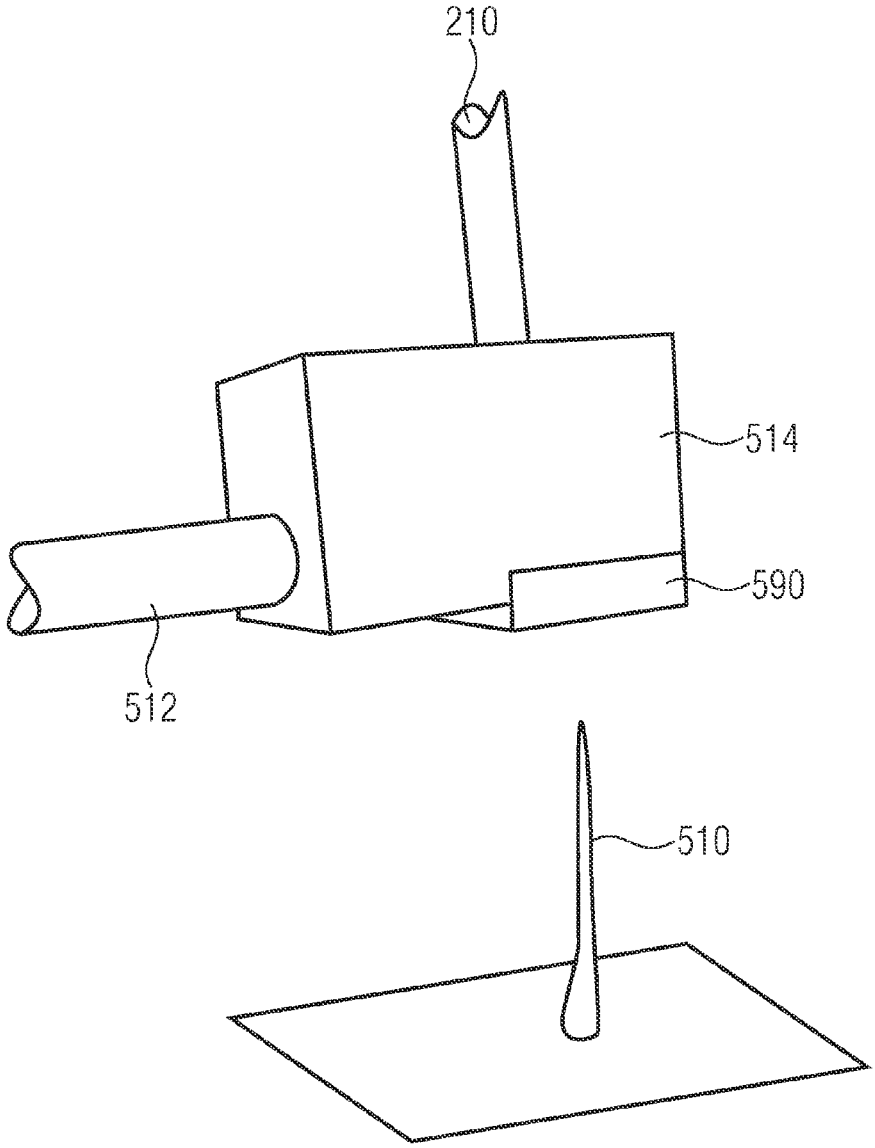
Figure 5C:
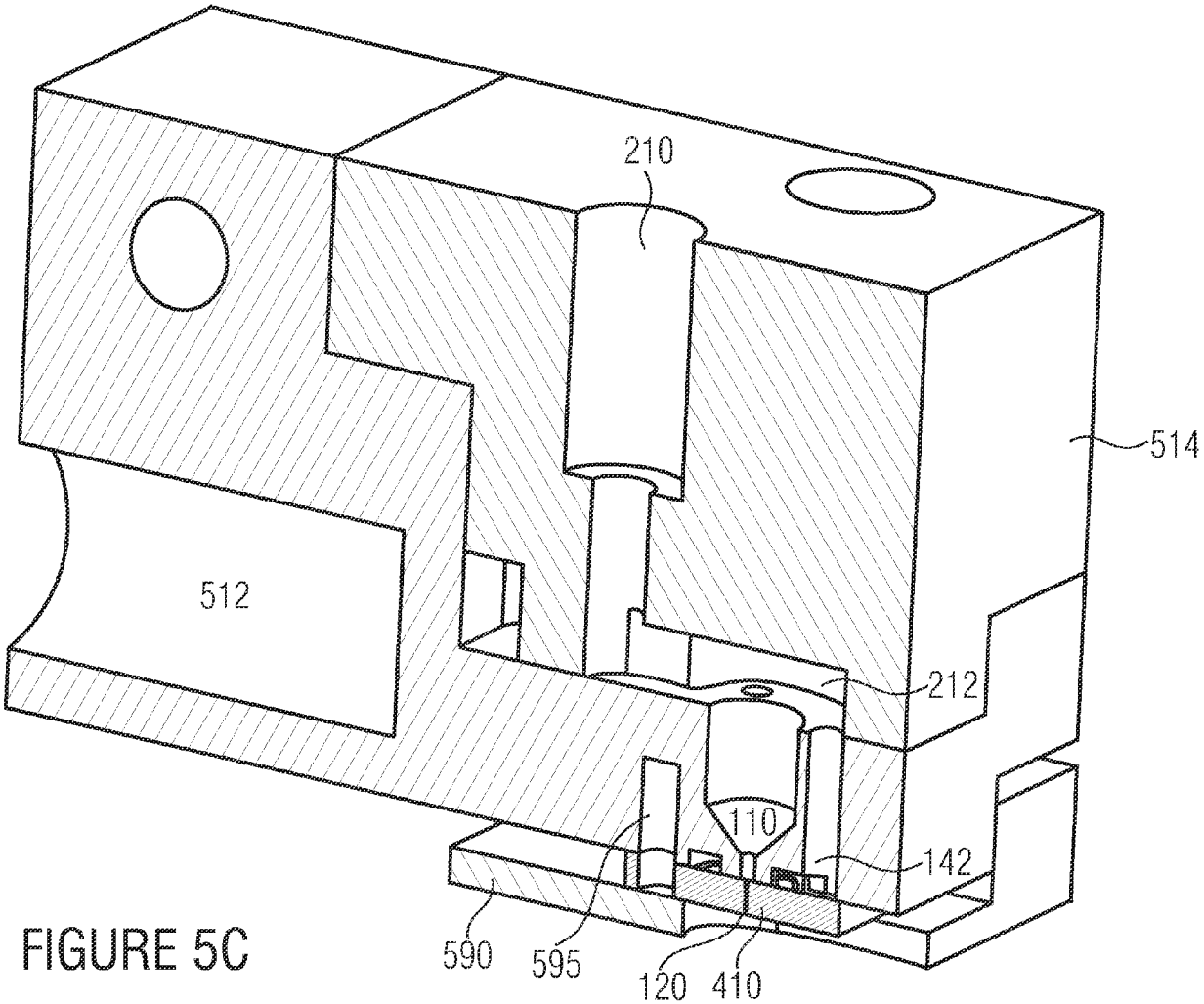

FIGS. 5A-5C show different illustrations of the structured test system with the chip 410 (hatched area) according to FIGS. 4A and 4B as well as a printed structure 510 of soldering tin drops. The illustrated test system has a heating element 512, a print head 514, a gas feed line 210, a camera 522 and a light source 524. Thereby, the chip 410 is mounted directly below a closed reservoir or reservoir block 514, for example of brass, which can be heated by means of a heating element 512. FIG. 5B shows a schematic illustration of the test system without light source 524 and camera 522. FIG. 5C shows a cross-section of block 514 with heating element 512, with the feed line 210 for pneumatically activating the drop formation, with the reservoir 110 and the common region 212, via which the same pressure can be applied to the liquid in the reservoir 110 and to the upper inputs of the gas inlet channels 142 across the feed line 210. Thereby, in the embodiment according to FIG. 5C, the channel 120 is implemented in a chip 410, which can be mounted at a predetermined position at block 510 by means of a clamping device 590 and an adjusting pin 592, and can also be exchanged. The heating element or area 512 shown in FIGS. 5A-5C may include a cooling element, according to other preferred embodiments of the present invention.

The liquid reservoir 110 within the same comprises a bore towards the bottom having a diameter of 500 μm as outlet opening 112, such that the melt can enter centrally into the chip or the channel 120. Thereby, the orientation of the outlet opening 112 with respect to the channel is not critical, as long as the main region of the channel is covered, since the same condition for the capillarity of the subchannels holding the melt in the center according to [16] also has the effect that the melt cannot enter the gas channels 142 of the chip.

By bores having a diameter of 1 mm the gas channels 142, 144 of the chip are connected to the gas region 212 located above the liquid reservoir 110. The terminal 210 of the drive gas or secondary fluid at the gas region 212 of the pressure head is performed from the top via stainless steel tubing and pneumatic lines. Nitrogen is used as gas or secondary fluid. Two different gas pressures can be applied via a branch valve. The pressures are adjusted by the actuator in front of the valve.

In the state of rest, by means of a low gas pressure at the "normally open" channel of the valve, low nitrogen flow through the system is maintained. Thereby, oxidation of the melt is prevented. Prior to assembly, the reservoir 110 is filled with soldering tin.

At the "normally closed" terminal of the valve, gas pressure is applied, which is sufficient for generating drop ejection. Thereby, drops are generated with switched valve.

FIG. 5A shows the result of a high gas pressure applied for approximately 30 seconds. Since the melt already solidifies when impinging, a tower 510 of dosed soldering tin drops is formed.

Figure 6:
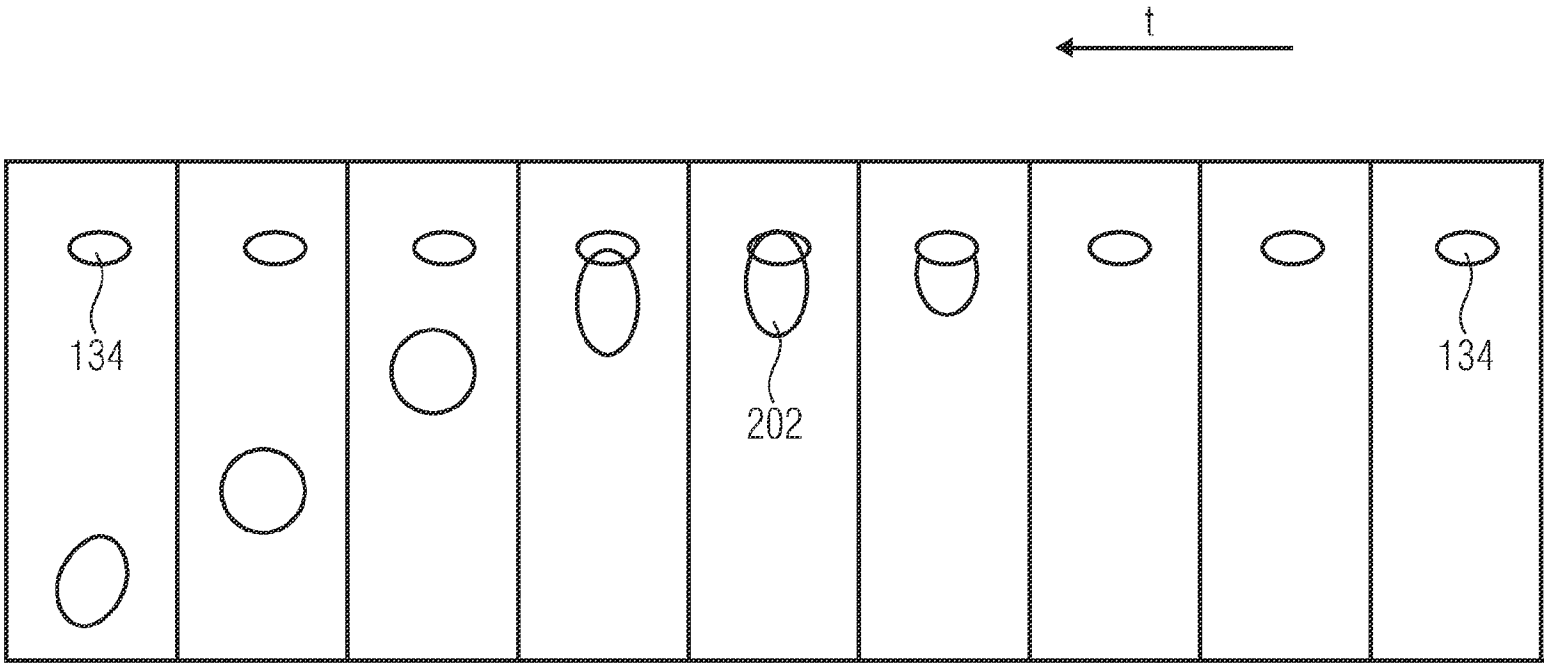
FIG. 6 shows a stroboscope image of a drop tear-off when using an inventive embodiment.

As expected, the drops tear off regularly within the test system, which can be seen in the stroboscopic images of the drop tear-off, see FIG. 6. It can be seen clearly in the stroboscope images in FIG. 6 that the liquid leaves the channel or nozzle not as jets, but already as single drops. Thereby, FIG. 6 shows the exit of the drop 202 with a time axis running from right to left (see arrow in FIG. 6).

Different nozzles or channel structures 110 have been produced, the images were taken with nozzles having an inner diameter of approximately 200 μm and 14 gas channels. Further tests have been made with nozzles having an inner diameter of approximately 100 μm and drops having a diameter of approximately 250 μm to 100 m have been generated.

By applying pressure pulses having a length of less than 5 ms, single drops could also be generated.

In the following, reference will be made to features of the invention that can exist individually or in combination in the embodiments.

The liquid to be dosed or the primary fluid is stabilized by capillary forces when entering the nozzle 120, especially with respect to the flow of the secondary fluid, effecting the drop formation and driving the drop ejection.

Further, embodiments of the nozzle 120 can have a profile like the star channel.

By reducing the contact line 134 in cross-section, for example by a star-shaped nozzle according to FIG. 2B, friction and adhesive forces between primary liquid and nozzle are minimized, and wetting the nozzle area is mostly prevented.

In embodiments, drop formation is realized already within the nozzle 120 which is induced by two-phase flow. In all known dosing devices that are to be operated continuously, drop tear-off and drop formation takes place outside the nozzle.

In embodiments, the constriction 116 generated by the secondary fluid applies a force supporting tear-off, which supports the drop tear-off, which is of significant advantage, especially in highly viscous media.

In embodiments, self-regulation takes place during drop generation in that within the nozzle a first drop only forms or can be formed when the last or previous drop has been ejected.

In embodiments, the exposed drop 202 can be immediately protected against oxidation by the gas flow or flow of the secondary fluid out of the nozzle, and depending on the application, the same can be protected against cooling off or overheating, without any negative influence on the jet direction.

In further embodiments, the drive operation merely takes place by flowing-in of the secondary fluid, wherein both continuous drop generation (comparable to "continuous ink-jet-method") as well as single drop generation (comparable to the drop-on-demand method) can be realized.

In embodiments, by increasing the flow velocity further or by increasing the pressure by which the secondary fluid is applied to the feed line 210 or directly to the inlet channels 142, 144, even suction of the primary fluid can take place by the secondary fluid flowing to the outside, which results in the generation of spray. Hence, three different modes of operation can be obtained with the same device merely by adjusting the gas pressure: continuous drop generation, single drop generation, spray generation.

In the following, embodiments or features and effects of embodiments will be described in other words.

Embodiments provide, for example, a device for generating liquid drops of a primary fluid consisting of at least one nozzle 120, whose cross-section profile is formed of a partial area 124 having a circular cross-section and at least one further partial area 126, a feed line channel 142 filled with a secondary fluid and at least one liquid reservoir 110 filled with a primary fluid, as well as at least one device for applying excess pressure to the feed line channel 142 and/or the liquid reservoir 110, wherein the nozzle 120 is fluidically connected both to the feed line channel 142 and to the liquid reservoir 110 at its one end 132.

A further embodiment of the present invention provides a device for generating liquid drops of a primary fluid consisting of a nozzle channel 120 having an inner region 124 and an outer region 126, a reservoir 110 filled with a primary fluid in fluidic contact 112 with the nozzle channel 120, a secondary fluid as well as a feed line 142 of the secondary fluid in fluidic contact with the nozzle channel 120, at least one device for generating a pressure to the primary fluid and to the secondary fluid, wherein due to capillary forces the primary fluid is guided in the inner area 124 of the nozzle 120 and the secondary fluid in the outer area 126, 128 of the nozzle channel 120, and this results in drops 202 of the primary fluid.

Another embodiment of the present invention provides a device for generating liquid drops of a primary fluid consisting of a nozzle channel 120, a reservoir 110 filled with primary fluid in fluidic contact 112 with the nozzle channel 120, a secondary fluid as well as a feed line 142, 144 of the secondary fluid in fluidic contact with the nozzle channel 120, and at least one device for applying excess pressure to the primary fluid and the secondary fluid.

Further embodiments of the above-stated device further have a nozzle 120, wherein more than five partial channels or sub-regions 126, 128 are equally grouped around a central channel or main region 124, wherein in the outer partial channels 126, 128 the option of introducing gas and in the central channel the option of introducing liquids is given.

Additionally, embodiments of the present invention can have a nozzle 120, that is formed such that the central channel 124 is formed by limitations between the outer channels 126, 128 projecting to the inside in a tapered manner, for reducing the flow resistance.

Further embodiments show a device where the secondary fluid is a gas and the primary fluid is a liquid.

In alternative embodiments, the secondary fluid and the primary fluid are liquids.

In further embodiments, the pressurization of the reservoir 110 and the feed line channel 142, 144 come from the same source, e.g. across a common feed line channel 210.

In other embodiments, the pressurization of the reservoir 110 and the feed line channel 142, 144 come from different sources.

Other embodiments of the present invention have a nozzle 120 with variable diameter or cross-sectional shape along the nozzle axis or the main flow direction.

Again, other embodiments have a liquid reservoir that can be heated up or cooled down for melting the primary fluid from the solid phase or for influencing its viscosity.

Further embodiments of the present device comprise at least one additional device allowing the generation of an electric or magnetic field outside the nozzle outlet for manipulating emerging drops.

Further, embodiments provide a method for generating liquid drops of a primary fluid comprising: filling a liquid reservoir with primary fluid, fluidically connected to at least one nozzle 120 whose cross-sectional profile is formed of a partial area having a circular cross-section and at least one further finite partial area 126; pressurizing the liquid reservoir, such that the primary fluid reaches the nozzle 120; pressurizing at least one feed line channel 126, 128 filled with secondary fluid, which is fluidically connected to the same nozzle 120, such that secondary fluid can reach into the nozzle.

In the further embodiments of the device or the method, the pressure is continuously applied to the reservoir 110 and/or the feed line channels 142, 144.

In further embodiments of the device and the method, merely a single pressure pulse is applied to the reservoir and/or the supply line channels in order to generate, for example, a single drop.

Additionally, in further embodiments of the device and the method, the primary fluid can be supplied to the reservoir 110 in the solid phase, to melt it then, for example, for generating a primary liquid.

In summary, it can be said that embodiments provide a device and method for dosing liquid drops with the help of a two-phase flow and allow non-contact dosage of liquids.

Thereby, embodiments are implemented, for example, to introduce a secondary fluid into a star-shaped nozzle at the edge and at the same time to press liquid out of a reservoir into the center. Thereby, the channel is implemented such that capillary forces of the structure have the effect that the liquid remains only in the center or main region of the channel. Since the liquid impedes the secondary fluid flow, the pressure on the liquid increases and a drop tears off. Embodiments use, for example, the laminar geometry in the nozzle with capillary control of the drop in front of the same, and actuator technology by controlling the secondary fluid flow for the drop tear-off.

Hence, embodiments of the invention can further be implemented to eliminate one or several disadvantages of the known devices, namely: complex actuator technology, dependency of the drop volume on the medium, adhesion of drops at the nozzle outlet, no protective gas when dispensing melts, only single drops or jet dosage, no dosage of highly viscous media.

In other words, embodiments of the invention allow: simple actuator technology by secondary fluid, effecting and supporting drop tear-off, suppresses tear-off of subsequent drops and serves as protective gas for melts; determining the volume by the geometry of the channel; drop tear-off already within the nozzle, supported drop tear-off allows tear-off of highly viscous media; suppression of adhesion by hydrophobic laminar geometry; adjustability between jet and single drop by actuation time; and nozzle diameters of less than 100 μm.

Alternative embodiments of the device and respective method for generating a drop 202 of a primary liquid can comprise: a reservoir 110 fillable with the primary liquid; and a channel 120 having a flow cross-sectional transverse to a main flow direction 122 of a secondary fluid, wherein the flow cross-section has a main region 124 and at least one sub-region 126, 128 extending from the main region, wherein the channel 120 is implemented such that the primary liquid can be held in the main region by capillary forces, wherein the reservoir is fluidically connected to the channel 120 at a first end 132 of the channel via an output opening 112, and wherein the main region 124 and the at least one sub-region 126 are implemented such that when the secondary fluid flows, for example, along the main flow direction through at least the sub-region of said channel, part 114 of the primary liquid can extend into the main region 124 of the channel due to a pressure difference between a pressure in the reservoir and a pressure in the channel 120 resulting due to this flow, such that a flow resistance for the secondary fluid in the channel becomes higher, which reduces the pressure difference, such that due to an inertia of the part 114 of the primary liquid extending into the main region of the channel as well as the flow resistance of the secondary fluid and the surface tension of the primary fluid a drop 202 can come off from the part of the primary liquid 114 in the channel extending into the main region of the channel.

Thereby, the flow of the secondary fluid can be generated and/or controlled by means of a pressure generation device as described above. The other statements regarding the above embodiments apply accordingly.

Fields of application of the invention are, for example, ink jet printers, nanoliter and picoliter dosing devices of different types, ink printers, systems for particle generation, for example for pharmaceutical or biotechnological applications.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A device for generating a drop the plurality of fingers of the channel are fluidically connected to the at least one inlet channel at the first end of the channel, whereby the primary liquid in the reservoir moves along the channel and is output as a free-flying drop at the second end of the channel.

2. Device according to claim 1, wherein the at least one inlet channel leads into the plurality of fingers in an angle of more than 70° and less than 110° with respect to the main flow direction.

3. Device according to claim 1, wherein the main region further comprises a circular flow cross-section.

4. Device according to claim 1, wherein the primary liquid can be a melted metal.

5. Device according to claim 1, wherein the reservoir comprises a heating element and/or the channel comprises a heating element.

6. Device according to claim 1, wherein the reservoir and/or the channel comprises at least one cooling element.

7. Device according to claim 1, wherein the plurality of fingers is separated from each other by wall sections running in a direction towards the main region.

8. The device according to claim 1, wherein the pressure generation device is configured to effect a flow of the secondary fluid along the main flow direction such that pressure difference can result, due to which the primary liquid can be moved into the main region of the channel.

9. The device according to claim 8, comprising: a feed line for the secondary fluid, fluidically connected to the reservoir and the at least one inlet channel, wherein the at least one inlet channel is configured such that the pressure difference results along the at least one inlet channel.

10. The device according to claim 1, wherein the pressure generation device is configured to generate the same amount of pressure on the primary liquid in the reservoir and on an input region of the at least one inlet channel.

11. The device according to claim 1, wherein the pressure generation device is configured to apply a pneumatic or hydraulic pressure pulse of a certain duration for generating a single drop.

12. The device according to claim 1, wherein the main region and the plurality of fingers are configured such that when the secondary fluid flows along the main direction through at least the plurality of fingers of the channel, part of the primary liquid can extend into the main region of the channel due to a pressure difference between a pressure in the reservoir and a pressure in the channel resulting due to this flow, such that a flow resistance for the secondary fluid in the channel becomes higher, which reduces the pressure difference, such that due to an inertia of the part of the primary liquid extending into the main region of the channel as well as the flow resistance of the secondary fluid and the surface tension of the primary liquid, a drop comes off from the part of the primary liquid extending into the main region of the channel.

13. The device according to claim 1, wherein the secondary fluid is a secondary gas, and the channel is configured such that a contact angle of the primary liquid with respect to the channel is larger than 90°.

14. The device according to claim 1, wherein the secondary fluid is a secondary liquid, and the channel is configured such that a contact angle of the primary liquid with respect to the channel is larger than a contact angle of the secondary liquid with respect to the channel.

15. Method for generating a drop of a primary liquid by means of a device comprising:

a reservoir arranged to receive the primary liquid;

at least one inlet channel for introducing a secondary fluid, and a channel including a first end, a second end, and a star-shaped flow cross-section transverse to a main flow direction between the first end and the second end, wherein the star-shaped flow cross-section includes a main region and a plurality of fingers extending from the main region, the plurality of fingers of the channel are fluidically connected to the at least one inlet channel at the first end of the channel;

at least the main region of the channel is fluidically connected to the reservoir at the first end of the channel;

the method comprising:

filling the reservoir with the primary liquid;

introducing the secondary through the at least one inlet channel into the plurality of fingers; and applying a pneumatic or hydraulic pressure to the primary liquid in the reservoir, whereby the primary liquid in the reservoir moves along the channel and is output as a free-flying drop at the second end of the channel.

* * * * *

UNITED STATES PATENT AND TRADEMARK OFFICE

CERTIFICATE OF CORRECTION

PATENT NO. : 8,877,145 B2
APPLICATION NO. : 13/106206
DATED : November 4, 2014
INVENTOR(S) : Tobias Metz et al.

It is certified that error appears in the above-identified patent and that said Letters Patent is hereby corrected as shown below:

IN THE CLAIMS

Claim 1 should recite as follows:

A device for generating a drop of a primary liquid, comprising:
a reservoir arranged to receive the primary liquid,
pressure generation device for generating a pneumatic or hydraulic pressure in the reservoir,
at least one inlet channel for introducing a secondary fluid, and
a channel including a first end, a second end, and a star-shaped flow cross-section transverse to a main flow direction between the first end and the second end, wherein
the star-shaped flow cross-section includes a main region and a plurality of fingers extending from the main region,
the plurality of fingers of the channel are fluidically connected to the at least one inlet channel at the first end of the channel,
at least the main region of the channel is fluidically connected to the reservoir at the first end of the channel, and
the pressure generation device is configured to apply a pneumatic or hydraulic pressure in the reservoir, whereby the primary liquid in the reservoir moves along the channel and is output as a free-flying drop at the second end of the channel.

The preamble of each of claims 2-7 should recite:

"The device according to claim 1"

Signed and Sealed this
Twenty-ninth Day of December, 2015

Michelle K. Lee

Michelle K. Lee
*Director of the United States Patent and Trademark Office*